US006820362B1

(12) United States Patent
Petrus

(10) Patent No.: US 6,820,362 B1
(45) Date of Patent: Nov. 23, 2004

(54) LATCH AND LOCKING ASSEMBLY

(76) Inventor: Victor Petrus, 1497 S. Lakeshore Dr., Ludington, MI (US) 49431-9355

( * ) Notice: Subject to any disclaimer, the term of this patent is extended or adjusted under 35 U.S.C. 154(b) by 0 days.

(21) Appl. No.: 10/755,023

(22) Filed: Jan. 9, 2004

Related U.S. Application Data

(63) Continuation-in-part of application No. 10/354,554, filed on Jan. 30, 2003, now Pat. No. 6,684,548.

(51) Int. Cl.[7] ..... F41A 17/00

(52) U.S. Cl. ..... 42/70.11; 211/64; 211/4; 70/58; 70/229; 70/232

(58) Field of Search ..... 42/70.11; 211/64, 211/4; 70/58, 229, 232

(56) References Cited

U.S. PATENT DOCUMENTS 4,182,453 A * 1/1980 Worswick ..... 211/4
4,198,026 A * 4/1980 Capolupo ..... 248/552
4,444,031 A * 4/1984 Watson ..... 70/232
4,751,831 A * 6/1988 Morris, Jr. et al. ..... 70/159
4,793,163 A 12/1988 MacFarlane et al.
5,022,536 A * 6/1991 Pierson ..... 211/64
5,579,923 A * 12/1996 Hemmerlein ..... 211/4
5,794,463 A * 8/1998 McDaid ..... 70/18
6,393,877 B1 * 5/2002 Church ..... 70/62
6,588,242 B1 * 7/2003 Beaty ..... 70/231
6,684,548 B1 * 2/2004 Petrus ..... 42/70.11

* cited by examiner

*Primary Examiner*—J. Woodrow Eldred
(74) *Attorney, Agent, or Firm*—King & Jovanovic, PLC

(57) ABSTRACT

A latch and locking assembly. The latch comprising a hasp member. The hasp having a base wall, a side wall and an attachment member. The base wall including a mounting structure for mounting the base wall to a first structure. The side wall having an aperture. The attachment member attaching the base wall to the side wall. The locking assembly comprising a sleeve, a fastening assembly and a lock. The sleeve includes a body, an axial bore and an opening through the body. The axial bore includes a internal fastener assembly contact surface. The fastening assembly is capable of extending through the sleeve and into engagement with a wall, and includes a collar and a threaded fastener. The collar includes an axial bore mating surface. The threaded fastener includes a tool engagement region and a wall engagement region. The lock includes a portion which is positionable through the at least one opening in the body. The internal fastener assembly contact surface and the axial bore mating surface interface to facilitate rotative and pivotable relative movement of the sleeve and the fastening assembly. In turn, the retained movement of the fastening assembly with rotation of the sleeve is precluded.

20 Claims, 7 Drawing Sheets

LATCH AND LOCKING ASSEMBLY

CROSS-REFERENCE TO RELATED APPLICATION

The present application is a continuation in part of U.S. patent application Ser. No. 10/354,554 filed Jan. 30, 2003 now U.S. Pat. No. 6,684,548 entitled "Locking Assembly for Securing Firearms and the Like," the entire specification of which is incorporated by reference.

BACKGROUND OF THE INVENTION

1. Field of the Invention

The present invention relates in general to locking assemblies, and more particularly to a latch and locking assembly for use therewith. For example, the latch may comprise a hasp type latch.

2. Background Art

The use of latches and locking assemblies has been used for centuries. One such latch has been a hasp type latch which includes two components, a hasp member and a locking member. These types of locks suffer from certain drawbacks. Among other drawbacks, there is a need for a simplified locking member which can be utilized reliably for many years in harsh environments. Generally, the current locking members are prone to damage from the elements and the like. Moreover, conventional locking members have been found to be somewhat prone to tampering. Indeed, it is generally the locking member, not the hasp member that is compromised.

It is therefore an object of the invention to provide a hasp type latch and locking assembly which overcomes the deficiencies of the prior art.

These objects as well as other objects of the present invention will become apparent in light of the present specification, claims, and drawings.

SUMMARY OF THE INVENTION

The invention comprises a latch and locking assembly. The latch comprises a hasp member. The hasp having a base wall, a side wall and an attachment member. The base wall including a mounting structure for mounting the base wall to a first structure. The side wall includes an aperture. The attachment member attaches the base wall to the side wall. The locking assembly comprises a sleeve, a fastening assembly, and a lock. The sleeve includes a body, an axial bore and an opening through the body. The axial bore includes a internal fastener assembly contact surface. The fastening assembly is capable of extending through the sleeve and into engagement with a wall, and includes a collar and a threaded fastener. The collar includes an axial bore mating surface. The threaded fastener includes a tool engagement region and a wall engagement region. The lock includes a portion which is positionable through the at least one opening in the body. The internal fastener assembly contact surface and the axial bore mating surface interface to facilitate rotative and pivotable relative movement of the sleeve and the fastening assembly. In turn, the retained movement of the fastening assembly with rotation of the sleeve is precluded.

In a preferred embodiment, the collar further includes a fastener engagement surface, and the fastener further includes a collar engagement region.

In another preferred embodiment, the collar and the fastener comprise an integrated assembly.

Preferably, the collar further comprises a wall engagement surface.

In a preferred embodiment, the sleeve includes a pair of openings positioned proximate the second end of the body.

In another preferred embodiment, the wall engagement region comprises a threaded region.

In yet another preferred embodiment, the tool engagement region is selected from the group consisting of: a Phillips or flathead screw head, an internal or external multi-sided head, and a bolt head.

In a preferred embodiment, the lock comprises a padlock.

In another preferred embodiment, the lock comprises a lock assembly having an interfering member and an activating means, the interfacing member being selectively extendable away from the sleeve by way of the activating means. In one such embodiment, the activating means comprises one of the group consisting of: key locks, combination locks and electronic locks.

In a preferred embodiment, the lock comprises an outer collar and an activating means. The outer collar has at least one interfering member positioned thereon and is extendable over at least a portion of the sleeve. The activating means is capable of maintaining the outer collar over a portion of the sleeve.

In yet another preferred embodiment of the invention, the internal fastener assembly contact surface comprises an internally concave surface.

In one such embodiment, the axial bore mating surface of the collar comprises an outwardly convex surface, capable of interfacing with the internally concave surface of the internal fastener assembly contact surface.

Preferably, the attachment assembly of the latch comprises a hinge.

In a preferred embodiment, the attachment assembly of the latch is positioned at an end of the side wall opposite of the aperture extending therethrough.

In a preferred embodiment, the aperture includes a recessed region, the sleeve includes a protrusion region along a portion thereof, the lock being configured so as to selectively enable and prohibit the relative movement of the sleeve and the fastening assembly so as to enable the locking of the sleeve in a configuration wherein the recessed region of the aperture and the protrusion region of the sleeve do not correspond.

BRIEF DESCRIPTION OF THE DRAWINGS

The invention will now be described with reference to the drawings wherein.

FIGS. *7a–7b* of the drawings comprise a partial perspective view of an embodiment of the latch and locking assembly of the present invention.

DETAILED DESCRIPTION OF THE INVENTION

Figure 1:
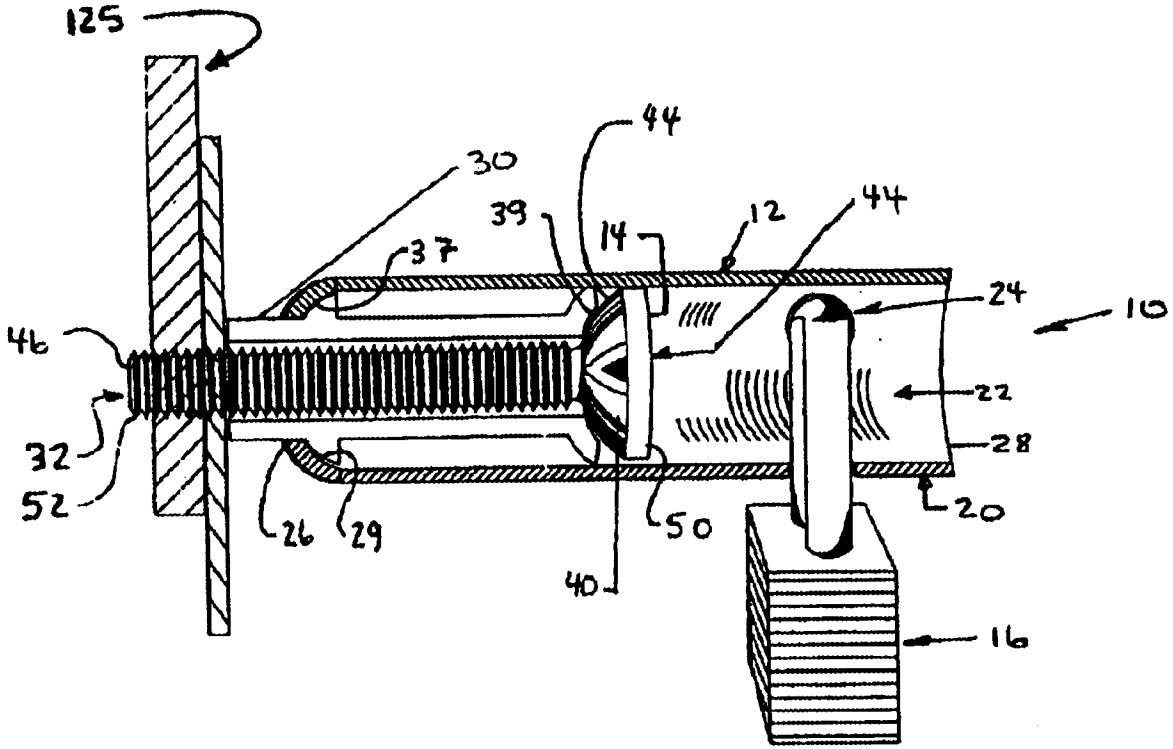
FIG. 1 of the drawings is a partial cross-sectional view of a locking system of the present invention, showing, in particular, a separate collar and fastener, intended for use in association with a relatively hard wall material.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the latch is referred to generally as 9, and the locking assembly is referred to as 10. It will be understood that the latch and locking assembly can be used to secure any number of different structures, such as doors, gates, cabinets, lockers, among others.

Figure 6:
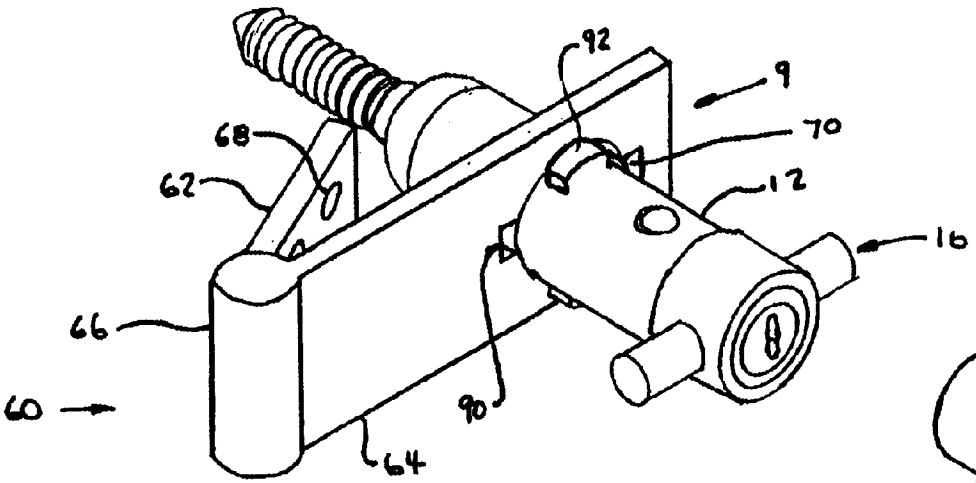
FIG. 6 of the drawings is a perspective view of an embodiment of the latch and locking assembly of the present invention.

Latch 9 is shown in FIG. 6 as comprising hasp member 60. Hasp member 60 includes base wall 62, side wall 64 and attachment assembly 66. Attachment assembly 66 comprises a hinge which facilitates the hinged movement of base wall 62 relative to side wall 64. Of course, other attachment assemblies are contemplated for use, including but not limited to various other types of pivotable, hinged, and relatively moveable members.

Base wall 62 is generally shorter than side wall 64 and includes mounting structure 68. In the embodiment shown, mounting structure 68 comprises a plurality of holes through which fasteners may be extended. In other embodiments, the mounting structure may comprise a plurality of tabs, slots, interfacing structures, locks and the like. Advantageously, inasmuch as the base wall is shorter than the side wall, the fasteners are covered by side wall 64 when the side wall is in the locking configuration.

Side wall 64 includes aperture 70 at an end distally spaced from attachment assembly 66. As will be explained, the aperture is sized so as to permit the positioning of the locking assembly therethrough. Due to the relative spacing of the aperture and the base wall, the base wall can be attached to a first structure (i.e., a door), whereas the locking assembly may be associated with a second structure (i.e., a doorjamb or a wall).

Locking assembly 10 comprises sleeve 12, fastening assembly 14 and lock 16. It is contemplated that locking assembly 10 comprises a hardened steel set of components, however other lightweight and high strength materials are contemplated for use. Similar materials are contemplated for latch 9.

Sleeve 12 is shown in FIG. 1 as comprising body 20, axial bore 22, and openings 24. Body 20 includes first end 26 and second end 28 distally spaced apart from first end 26. Body 20 generally includes an elongated substantially circular cross-sectional configuration. It is contemplated that the length of the body is generally such that it can easily accommodate the receipt of the aperture hasp member, but it is not long enough to provide a sufficient moment arm for one who is trying to disengage the assembly from the second structure. Of course, other configurations are likewise contemplated for use, including square, elliptical and other cross-sectional configurations. In addition, certain non-uniform cross-sectional configurations are likewise contemplated for use.

It is contemplated that in certain embodiments, a cover such as a neoprene material or another insulative material may be positioned or applied over the body 20 of sleeve 12 to preclude marring or scraping of outside components.

Axial bore 22 extends from first end 26 to second end 28. The bore is substantially uniformly configured, such that the body comprises a generally uniform thickness across the length thereof. Axial bore 22 proximate first end 26 further includes internal fastener assembly contact surface 29. In the embodiment shown, the internal fastener assembly contact surface comprises an inwardly concave internal surface. Such a beveled surface generally results in an narrowing or altering of the size of the opening of the axial bore proximate first end 26. As will be explained, such an internal surface cooperates with the fastening assembly to preclude the defeat of the locking assembly.

Openings, such as opening 24 extend through body 20 proximate the second end thereof. In certain embodiments, a single opening may be utilized, whereas, in other embodiments, multiple openings may be positioned proximate each other about the second end of the body. As will be explained, a lock or other selectively removable securement mechanism may be positioned through the openings to preclude access to the axial bore and to preclude the slidable movement of objects along the axial bore.

Fastening assembly 14 is shown in FIG. 1 as comprising collar 30 and threaded fastener 32. Collar 30 includes axial bore mating surface 37 and fastener engagement surface 39. Axial bore mating surface 37 extends about the outer end of collar 30 and contacts the axial bore. The axial bore mating surface is configured so as to permit both rotative movement of the collar relative to the sleeve, and to likewise permit pivoting and or "wobbling" of the collar relative to the sleeve (i.e., the contact between the elements is spread over a relatively large contact surface area). The configuration is such that the collar and the sleeve are generally precluded from lockable or restrainable movement in unison.

Fastener engagement surface 39 is shown in FIG. 1 as comprising an engagement surface which facilitates the pivoting, rotating and "wobbling" of a fastener relative to the collar. In the embodiment shown, the fastener engagement surface may comprise a compound curved beveled surface. Of course, other configurations are likewise contemplated, depending on the particulars of the application.

Variations in the configuration of the collar are contemplated. For example, in the embodiment shown in FIGS. 1 and 3, the assembly is contemplated for use in association with a relatively hard surface (i.e., a metal surface). In such an instance, collar 30 extends beyond first end 26 of the body 20 and beyond the axial bore thereof. As will be explained, during the construction, it is the collar that is directly attached to the underlying surface, and the sleeve is free to rotate, pivot and "wobble."

Figure 2:
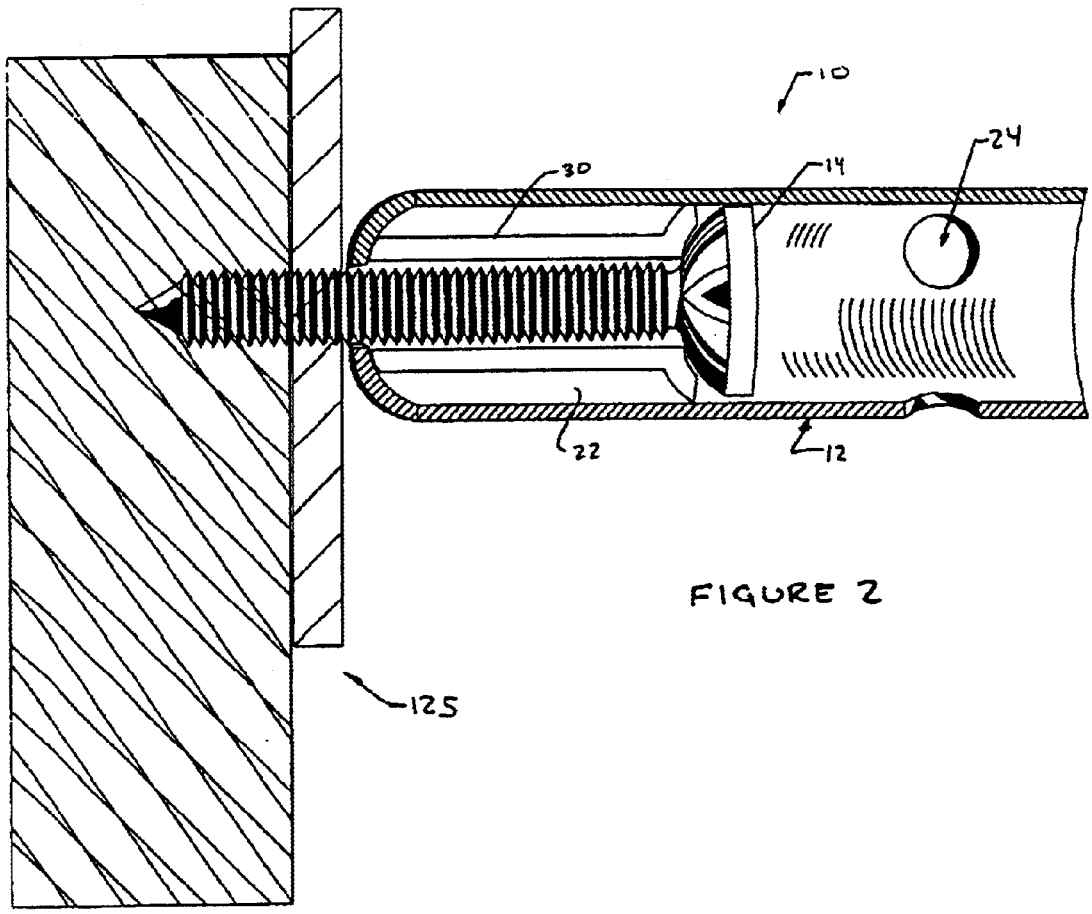
FIG. 2 of the drawings is a partial cross-sectional view of a locking system of the present invention, showing, in particular, a separate collar and fastener, intended for use in association with a relatively soft wall material.
Figure 4:
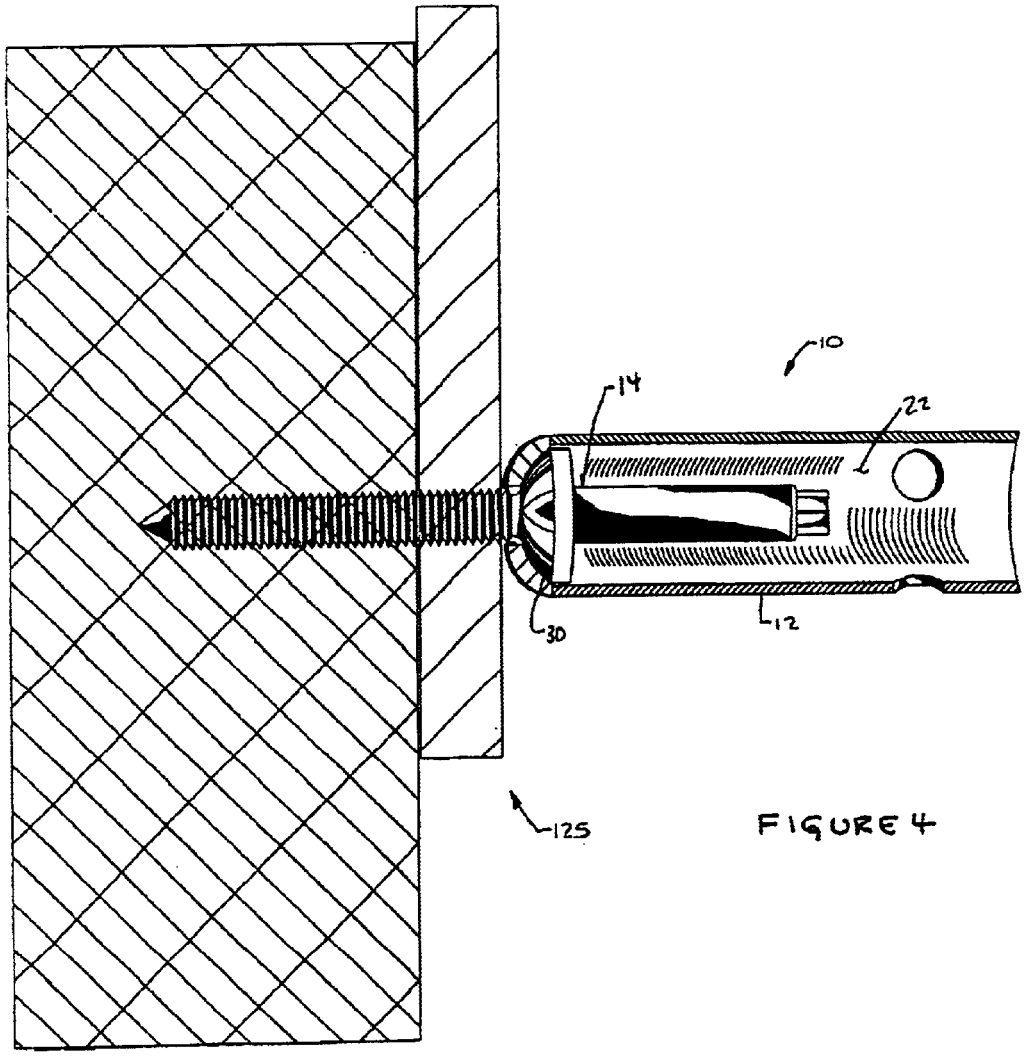
FIG. 4 of the drawings is a partial cross-sectional view of a locking system of the present invention, showing, in particular, an integrated collar and fastener, intended for use in association with a relatively soft wall material.
Figure 5:
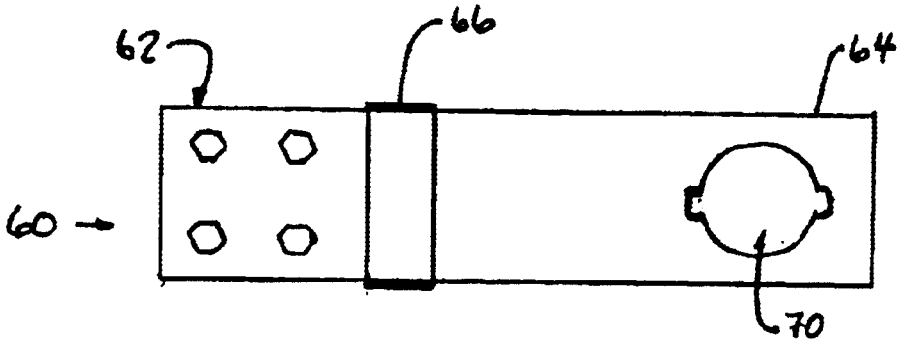
FIG. 5 of the drawings is a front elevational view of an embodiment of the latch of the present invention.

Additionally, in the embodiment of FIGS. 2 and 4, the assembly is contemplated for use in association with a relatively soft surface, such as wood, fiberboard, drywall, etc. In such an embodiment, the collar is contained within the axial bore of sleeve 12. As such, the first end of body 20 contacts the underlying surface, however, due to the relative softness of the material, the body is free to rotate about collar enclosed within the axial bore.

Threaded fastener 32 is shown in FIG. 1 as comprising body 40, tool engagement region 42, collar engagement region 44 and wall engagement region 46. Body 40 generally comprises an elongated body having a first end 50 and second end 52. Tool engagement region 42 is positioned proximate first end 50 of body 40. The tool engagement region may comprise any number of structures to which tools may be interfaced to, in turn, rotate the body. For example, the tool engagement region may comprise a Phillips or flathead screw head, an internal or external multi-sided head, a bolt head, among others. Additionally, safety or tamper resistant fasteners are likewise contemplated for use. Indeed, the invention is not limited to any particular type of tool engagement region.

Collar engagement region 44 is shown in FIG. 1 as comprising a surface which is capable of mating with the fastener engagement surface 39 of collar 30. In one embodiment, collar engagement region 44 comprises a compound curved beveled surface which substantially corresponds to the fastener engagement surface 39. Such a configuration facilitates the rotation, pivoting and "wobbling" of the fastener and the collar relative to each other. Of course, in other embodiments, other surface configurations for the collar engagement region are contemplated, as long as the above-described interaction with the collar can be achieved.

Wall engagement region 46 may comprise any number of different configurations, depending on the particular material from which wall 125 is constructed. For example, the wall engagement region may be threaded so as to facilitate attachment to a drywall/stud or to a wood material. In other embodiments, the wall engagement region maybe threaded for securement to a sheet metal structure, a concrete or other masonry structure, or to a plastic structure. In still other embodiments, the wall engagement region can be configured with machine threads for releasable attachment to an outside surface with a nut (i.e., a nut and bolt arrangement). Of course, other attachment structures for attachment to an outside structure are contemplated for use.

Figure 3:
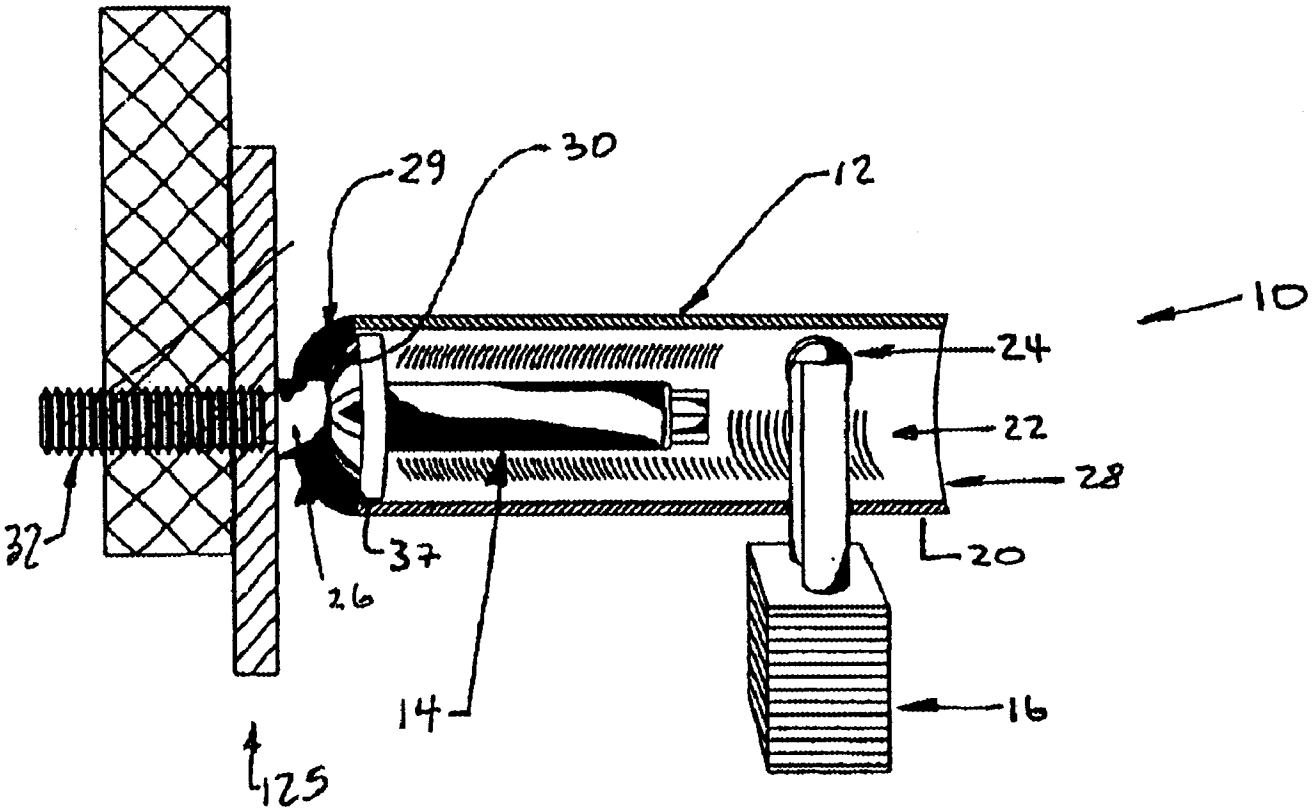
FIG. 3 of the drawings is a partial cross-sectional view of a locking system of the present invention, showing, in particular, an integrated collar and fastener, intended for use in association with a relatively hard wall material.

It is contemplated that in certain embodiments, such as the embodiment shown in FIGS. 3 and 4, collar 30 and fastener 32 may be integrated into a single member. In such an embodiment, a fastener engagement region and a collar engagement region is not utilized, as the components are integrated. It will be understood that depending on the wall material and the configuration selected, collar 30 may extend beyond axial bore 22 (FIG. 3), or may be retained within the axial bore (FIG. 4).

Lock 16 is shown in FIG. 1 as comprising a conventional pad lock. Such pad locks are available from numerous manufacturers, including but not limited to Master Locks and American Locks. Such locks may be opened through combination means or through a separate key. Of course, other locking mechanisms, such as cables, and other locks are likewise contemplated for use.

In operation, the user first selects a first structure to which to mount the latch, and the second structure to which to mount the locking assembly.

The user then selects a fastening assembly for the lock assembly and fasteners which to utilize with the latch. For example, different wall engagement regions are utilized with each of wood, drywall/metal studs, concrete.

Once the desired fastening assembly and sleeve is chosen, the user prepares the wall for receipt of the wall engagement region of the threaded fastener. For example, drilling the wall with a pilot hole may be necessary with certain configurations. Of course, with certain configurations, no such preparation is required. Once the wall is prepared, the fastening assembly and the sleeve are assembled. In particular, collar 30 and threaded fastener 32 are inserted through axial bore 22 from the opening proximate the second end thereof.

Once inserted, a suitable tool can be used to interface with tool engagement region 42 of fastening assembly 14 to, in turn, direct wall engagement region 46 into wall 125. Generally, the wall engagement region is directed into the wall until one of the collar and the first end of body 20 firmly engage wall 125. As explained above, regardless of whether the collar and the fastener comprise integrated or separate components, depending on the embodiment collar 30 may protrude beyond first end 26 of body 20, or collar 30 may be fully contained within the body.

Once the sleeve and fastening assembly are secured to the wall/second structure 125, the latch is secured to the first structure by way of mounting structures and associated fasteners. Once completed, the lock is ready for use. Specifically, the aperture of the latch can be passed along the sleeve of the locking assembly. Subsequently, lock 16 may be introduced. Specifically, the lock can be extended through openings 24 of sleeve 12 and then secured. The lock thus, spans at least partially across bore 22, thereby precluding access to tool engagement region 42. Additionally, the lock creates an obstacle which precludes slidable detachment of the aperture and, in turn the hasp member from engagement with the sleeve.

Inevitably, one that is desirous of disabling the locking assembly will attempt to lock the sleeve and the fastening assembly, or wedge the two structures together. The underlying thought is that if the sleeve can be rotated, it will, in turn, rotate the fastening assembly. Further rotation of the fastening assembly would then disengage the fastening assembly from the wall. However, with the construction of axial bore mating surface 37 of collar 30 and bevel surface 29 of axial bore 22, engagement of the fastening assembly by manipulation of the sleeve is precluded by the rotatable and pivotable interaction of these surfaces. In turn, it is not possible to disengage the fastening assembly from the wall by interference thereof with the sleeve.

Figure 8:
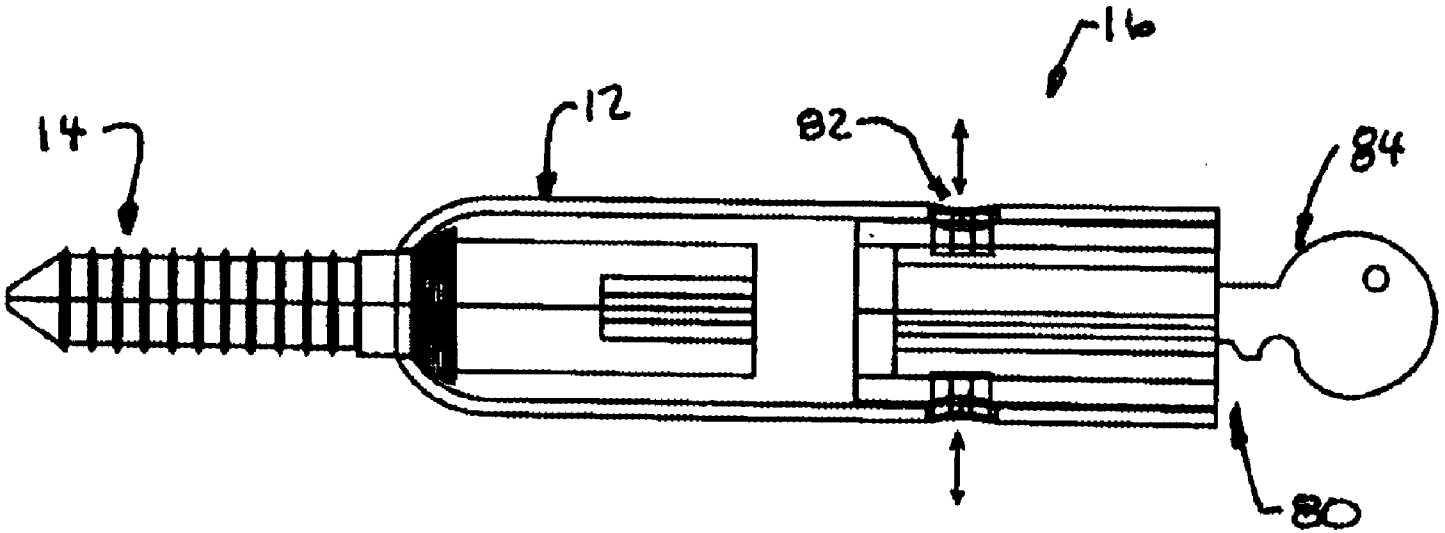
FIG. 8 of the drawings is a side elevational view of an embodiment of the locking assembly of the present invention.

In another embodiment of the invention, as shown in FIG. 8, lock 16 may comprise lock assembly 80. Lock assembly 80 includes an interfering member, such as interfering member 82 and an activating means 84. The interfering member 82 is configured to selectively extend through the openings on the sleeve, when directed by activating means 84. Activating means 84 may comprise any one of a conventional key operated lock, a combination lock, an electronic lock, among others. It will be understood that when activated, the interfering member 82 extends through openings of the sleeve to preclude the passage of the aperture of latch 9 from passing therebeyond. Upon deactivation of the activating means 84, the interfering member is retracted toward the interior of the sleeve, thus permitting the passage of latch 9 therebeyond.

Figure 7B:
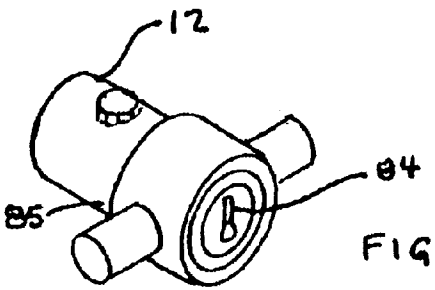
Figure 7A:
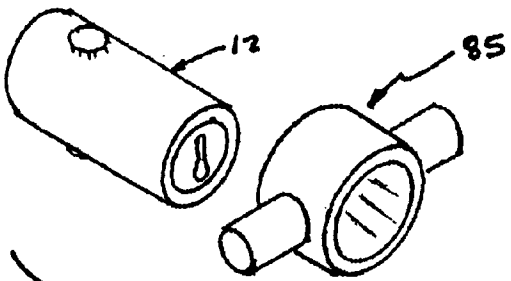

In another embodiment, as is shown in FIGS. 7*a* and 7*b*, the interfering member may comprise an outer collar, such as outer collar 85 that is placed over the sleeve of the locking assembly. The activating means 84 provides a means by which to lock the outer collar relative to the sleeve, to, in turn, preclude relative movement thereof.

In yet another embodiment, as is shown in FIG. 6, the aperture of the latch may include a recessed region, such as recessed region 90. The sleeve of the locking assembly may include a protruding region 92 which substantially mates with recessed region 90. As such, the latch may be extended beyond the protruding region of the sleeve only when the sleeve is positioned such that the protruding region and the recessed region correspond. Rotative movement of the sleeve such that the protruding region and the recessed region do not correspond, precludes relative movement of the aperture along the sleeve beyond the protruding region. The lock may be configured so as to maintain the sleeve in a particular orientation relative to the underlying fastening assembly. As such, upon positioning of the latch in a closed configuration, the sleeve is rotated such that the protruding region and the recessed region do not correspond. Subsequently, the lock is activated such that the sleeve is precluded from movement. The noncorresponding orientation of the sleeve precludes relative movement of the latch thereagainst. The particular configuration of the aperture to preclude its movement upon rotation of the sleeve may be adapted by those having skill in the art.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A latch and locking assembly, the latch comprising:

a hasp member having
- a base wall including a mounting structure for mounting the base wall to a first structure;
- a side wall having an aperture; and
- an attachment member attaching the base wall to the side wall;

the locking assembly comprising:

a sleeve including:
- a body, being configured such that at least a portion thereof is capable of extending through the aperture of the side wall;
- an axial bore extending through the body, the axial bore having a internal fastener assembly contact surface; and
- at least one opening through the body;

a fastening assembly capable of extending through the sleeve and into engagement with a second structure, the fastening assembly including:
- a collar having an axial bore mating surface;
- a threaded fastener having a tool engagement region and a wall engagement region; and a lock having a portion which is positionable through the at least one opening in the body, wherein the internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

2. The latch and locking assembly of claim 1 wherein:

the collar further includes a fastener engagement surface; and the fastener further includes a collar engagement region.

3. The latch and locking assembly of claim 1 wherein the collar and the fastener comprise an integrated assembly.

4. The latch and locking assembly of claim 1 wherein the collar further comprises a wall engagement surface.

5. The latch and locking assembly of claim 1 wherein the sleeve includes a pair of openings positioned proximate the second end of the body.

6. The latch and locking assembly of claim 1 wherein the wall engagement region comprises a threaded region.

7. The latch and locking assembly of claim 1 wherein the tool engagement region is selected from the group consisting of: a Phillips or flathead screw head, an internal or external multi-sided head, and, a bolt head.

8. The latch and locking assembly of claim 1 wherein the lock comprises a padlock.

9. The latch and locking assembly of claim 1 wherein the lock comprises a lock assembly having an interfering member and an activating means, the interfacing member being selectively extendable away from the sleeve by way of the activating means.

10. The latch and locking assembly of claim 9 wherein the activating means comprises one of the group consisting of: key locks, combination locks and electronic locks.

11. The latch and locking assembly of claim 1 wherein the lock comprises:

an outer collar having at least one interfering member positioned thereon, the outer collar extendable over at least a portion of the sleeve; and an activating means capable of maintaining the outer collar over a portion of the sleeve.

12. The latch and locking assembly of claim 1 wherein the internal fastener assembly contact surface comprises an internally concave surface.

13. The latch and locking assembly of claim 12 wherein the axial bore mating surface of the collar comprises an outwardly convex surface capable of interfacing with the internally concave surface of the internal fastener assembly contact surface.

14. The latch and locking assembly of claim 1 wherein the attachment assembly of the latch comprises a hinge.

15. The latch and locking assembly of claim 1 wherein the attachment assembly of the latch is positioned at an end of the side wall opposite of the aperture extending therethrough.

16. The latch and locking assembly of claim 1 wherein the aperture includes a recessed region, the sleeve includes a protrusion region along a portion thereof, the lock being configured so as to selectively enable and prohibit the relative movement of the sleeve and the fastening assembly so as to enable the locking of the sleeve in a configuration wherein the recessed region of the aperture and the protrusion region of the sleeve do not correspond.

17. A latch and locking assembly, the locking assembly comprising:

a hasp member having
- a base wall including a mounting structure for mounting the base wall to a first structure;
- a side wall having an aperture; and
- an attachment member attaching the base wall to the side wall; and a sleeve including:

a body;

an axial bore extending through the body, the axial bore having a internal fastener assembly contact surface; and at least one opening through the body, the at least one opening configured for receipt of a portion of a lock; and a fastening assembly capable of extending through the sleeve and into engagement with a wall, the fastening assembly including:

a collar having an axial bore mating surface;

a threaded fastener having a tool engagement region and a wall engagement region;

wherein the internal fastener assembly contact surface of the sleeve and the axial bore mating surface of the collar interface to facilitate rotative and pivotable movement of the sleeve relative to the fastening assembly, and to, in turn, preclude the retained movement of the fastening assembly with rotation of the sleeve.

18. The latch and locking assembly of claim 1 wherein the lock comprises a lock assembly 80 having an interfering member and an activating means, the interfacing member being selectively extendable away from the sleeve by way of the activating means.

19. The latch and locking assembly of claim 18 wherein the activating means comprises one of the group consisting of: key locks, combination locks and electronic locks.

20. The latch and locking assembly of claim 17 wherein the lock comprises:

an outer collar having at least one interfering member positioned thereon, the outer collar extendable over at least a portion of the sleeve; and a lock capable of maintaining the outer collar over a portion of the sleeve.

* * * * *